US008622854B2

(12) United States Patent
Suzuki

(10) Patent No.: US 8,622,854 B2
(45) Date of Patent: Jan. 7, 2014

(54) BASEBALL BAT SWING AID

(76) Inventor: Takahiko Suzuki, Irvine, CA (US)

( * ) Notice: Subject to any disclaimer, the term of this patent is extended or adjusted under 35 U.S.C. 154(b) by 252 days.

(21) Appl. No.: 13/154,300

(22) Filed: Jun. 6, 2011

(65) Prior Publication Data

US 2012/0142456 A1 Jun. 7, 2012

Related U.S. Application Data

(60) Provisional application No. 61/357,518, filed on Jun. 22, 2010.

(51) Int. Cl.
*A63B 69/00* (2006.01)

(52) U.S. Cl.
USPC ..... 473/453; 473/422

(58) Field of Classification Search
USPC ..... 473/519, 233, 453, 422; 73/492, 493, 73/379.01; 446/170, 171, 169; 116/324
See application file for complete search history.

(56) References Cited

U.S. PATENT DOCUMENTS 514,420 A * 2/1894 Jacobus ..... 473/564
1,926,921 A * 9/1933 Smyley ..... 482/110
2,780,098 A * 2/1957 Maroth ..... 73/379.01
3,215,437 A 11/1965 Webb
3,578,801 A 5/1971 Piazza
3,972,528 A 8/1976 McCracken et al.
4,014,542 A 3/1977 Tanikawa
4,025,377 A 5/1977 Tanikawa
4,470,302 A * 9/1984 Carte ..... 73/492
4,871,168 A 10/1989 Autorino et al.
4,967,596 A * 11/1990 Rilling et al. ..... 73/492
5,014,984 A 5/1991 Brockhoff
5,160,142 A 11/1992 Marshall
5,261,269 A * 11/1993 Barker ..... 73/40.7
5,395,107 A 3/1995 De Pippo
5,482,270 A * 1/1996 Smith ..... 473/568
5,839,983 A 11/1998 Kramer
5,935,015 A 8/1999 Spiegel
6,338,687 B1 1/2002 Thompson
6,923,737 B1 8/2005 Walker
7,041,017 B1 5/2006 Carfo
7,125,353 B2 10/2006 Blount
7,351,167 B1 4/2008 Hathaway
2009/0325736 A1 12/2009 Carsello
2010/0041500 A1 2/2010 Whitney et al.
2011/0319833 A1* 12/2011 Chun ..... 604/198
2012/0142456 A1* 6/2012 Suzuki ..... 473/453

* cited by examiner

*Primary Examiner* — Alvin Hunter
*Assistant Examiner* — M Chambers
(74) *Attorney, Agent, or Firm* — Alexander Chen, Esq.

(57) ABSTRACT

An inertia-based baseball bat swing indicator, whether built into a baseball bat or retrofitted onto an existing bat, which visually indicates by inertia-propelled beads in separate grooves along the apparatus whether the alignment and body mechanics of the batter are proper during the bat swing.

11 Claims, 10 Drawing Sheets

BASEBALL BAT SWING AID

CROSS REFERENCE TO RELATED APPLICATIONS

This application claims the benefit of the filing date of U.S. Provisional patent application Ser. No. 61,357,518 title "Baseball bat swing aid" filed on Jun. 4, 2010, the disclosures of which are incorporated herein by reference.

FIELD OF THE INVENTION

The present invention entails a precise baseball bat swinging aid with inertia-based swing indicator built into a baseball bat and molded grip optimizer, which will teach correct swinging technique of a baseball bat for athletes and recreational sports players. The invention generally relates to instructional devices for teaching and improving a correct bat swing through use of said specifically-molded grip and attachable or built-in inertia-based swing aid.

BACKGROUND OF THE INVENTION

The sport of baseball is much more complex than the simple swinging of a stick to hit a ball. In fact, the bat, itself, is a complex invention. The bat is carefully carved and constructed to allow for a quick and balanced swing with power. The barrel of the bat is meant to hit the ball, and contains a sweet spot of optimum hitting performance of a ball. The barrel narrows into a handle and ends with a knob, which keeps the bat from sliding out of the batter's hands. The bat handle is very thin so that batters can comfortably set their fingers in a grip. On metal bats, there is often rubber or cloth wrapping around the handle to optimize the gripping surface. However, the actual practice of gripping the bat handle is not intuitive and is not well-known or taught. The baseball bat has evolved through many physical form evolutions to become somewhat standardized in form today.

The baseball swing is known to be one of the most difficult tasks in sports. In order to successfully hit a baseball, a person must match his bat swing as closely as possible and for as long as possible with the path of the baseball thrown by the pitcher. The hitter must simultaneously consider several technical strategies, such as how level the swing is in relation to different planes, the angle of the elbows, and grip technique. The key to successful baseball hitting is to have a good swing that is repeatable and adjustable to the angle of the pitched ball. Since the pitcher is standing above the hitter on the mound, he is throwing the ball from his shoulder and the ball will travel in a downward flight to the strike zone. Therefore, the optimal swing plane for the bat will be a slight upswing to match the downward angle of the ball flying towards the strike zone. Once a hitter has mastered a good swing with solid fundamental technique, he is prepared to effectively recognize a good pitch and properly meet it with a correct bat swing to excel in the sport. However, such technical mastery proves highly difficult without an effective practice aid. Most problematic for novices and even advanced batters are correct grip of the bat and correct swing technique and motion progression. The present invention seeks to solve these problems.

OBJECT OF THE INVENTION

Objectives of the present invention include production of a simple and precise teaching tool for teaching and correcting a player's baseball swing. This baseball teaching aid will prevent the generally mistaken batting action of casting out to hit the ball and instead facilitate a proper swing action of having the batter first pulling the left hand elbow (for the right hand batter that is) \and then pushes out by both hands to have the bat hit the ball and thereafter rotate wrist to create correct timing of rotating wrists to follow through the swing. Another objective of the present invention is to utilize an inertia-based swing indicator to provide feedback about the proper swing path, body movement progression, and alignment of the baseball bat during a swing in order to maximize the effectiveness of the baseball bat swing. Furthermore, an objective of the present invention is to teach and correct a batter's grip and for optimal swinging power, timing, and technical mastery.

SUMMARY OF THE INVENTION

The present invention contemplates a baseball bat swinging aid including a baseball bat with a grip positioning handle. When the batter grips the baseball bat, the batter's hands are properly aligned with each other so that the batter can manipulate the baseball bat properly when attempting to hit the baseball. In the proper position, the knuckles are lined up. During a proper bat swing, the batter's bat is generally horizontal with the playing field. During the proper bat swing, the batter's left arm initiates the left turn of the batter's upper torso. The batter's wrists do not rotate until after the baseball bat contacts the baseball. Prior to contact, the batter's right arm pushes forward so that the power of the batter is pushed forward into the ball. In all incorrect bat swing, the user swings the baseball bat by casting out by hitting the ball by extending both hands. The concept is to accelerate the bat as fast as possible to transfer maximum power to the baseball. Unfortunately, this sends the power of the batter sideways, not forward. Also, the incorrect and correct bat swings produce different inertia, profiles along the swing path. The baseball bat may be retrofitted with a swing indicator, which takes advantage of different inertia profiles between the correct and incorrect bat swings. The swing indicator has a bead that travels within one of two grooves, namely, the upper and lower groove. Initially, the bead resides within the single upper groove on the left hand side of the swing indicator. When the batter properly swings the bat by first pull by the left elbow then by pushing out, contacting the ball, then rotating the wrist, the bead will enter the tower groove of the swing indicator. However, when the batter incorrectly swings by casting out without pulling the elbow and rotates the wrists while contacting the ball, then the bead will enter the upper groove due to the casting action, indicating an incorrect swing. The bead moves within the upper and lower groove based on the inertia profile created by the batter's swing.

Both the grip positioner and the swing indicator work in conjunction with each other. The reason is that the grip positioner enables the batter to be able to execute a proper bat swing. The swing indicator indicates whether the batter has accomplished the proper bat swing. The grip positioner may be built into a baseball bat or may be produced as an independent unit to be attached later via attachment means, such as velcro, button strap, form-fitting slip-on, or chemical bonding.

The bat swing aid indicator unit may be built into a baseball bat or produced independently to be attached later via attachment means, such as velcro, button strap, form-fitting slip-on, or chemical bonding. Furthermore, the grip positioner and bat swing indicator may be produced together and packaged as a unit, or may be pre-assembled into a baseball bat and packaged as a unit.

One aspect of the invention is disclosed where a baseball bat swing indicator comprising an apparatus comprising a bead, a groove path in the apparatus wherein the bead may travel, a connector for connecting the apparatus and a baseball bat is disclosed. In one embodiment, the groove path comprises a upper groove path and a lower groove path. In one embodiment the groove upper groove path and the lower groove path formed a lateral Y shape groove path. In one embodiment the bead will enter the lower groove when a batter properly swings the baseball bat. In one aspect, the proper swing is when the batter pushes forward the baseball bat, thereafter the baseball bat contacts the ball at the right angle, thereafter the batter rotates his wrist.

In one embodiment the head will enter the upper groove when the batter incorrectly swings the baseball bat. In one embodiment the incorrect swing is when the batter rotates his wrists while contacting the ball. In one embodiment the bead moves within the upper and the lower groove based on the inertia profile created by a batter's swing. In one embodiment the kit further comprises a grip-positioning molded grip. In one embodiment the grip is specifically molded wherein a batter's hands are properly aligned with each other wherein the batter can manipulate the baseball bat properly when attempting to hit the baseball and wherein the batter's knuckles are properly lined up.

In another embodiment, the baseball bat swing indicator has groove path comprising main tube path, an upper tube path and a lower tube path. In another embodiment, the upper tube path is positioned above the lower tube path and the main tube path is positioned behind the upper tube path and the lower tube path in an area wherein the upper tube path is contiguous to the lower tube path. In another embodiment, the bead will enter the lower tube path when a batter properly swings the baseball bat. In another embodiment, a proper swing is when the batter first pulls his elbow and pushes forward the baseball bat, thereafter the baseball bat contacts a baseball; thereafter the batter rotates his wrist. In another embodiment, the bead will enter the upper tube path when the batter incorrectly swings the baseball bat.

In another aspect of the invention, a baseball bat incorporating the baseball bat swing indicator comprising an apparatus comprising a bead, a groove path in the apparatus wherein the bead may travel, a connector for connecting the apparatus and a baseball bat is disclosed.

In another aspect of the invention, a method to improve baseball bat swing comprising: a. providing a baseball bat; b. providing a baseball bat swing indicator comprising an apparatus comprising a bead, a groove path in the apparatus wherein the bead may travel, a connector for connecting the apparatus and the baseball bat; c. having a batter to swing the baseball bat wherein the baseball bat swing indicator will indicate if the swing is a proper swing is disclosed. In one embodiment, the method further includes providing a grip-positioning molded grip wherein the grip is specifically molded wherein the batter's hands are properly aligned with each other wherein the batter can manipulate the baseball bat properly when attempting to hit the baseball and wherein the batter's knuckles are properly lined up.

DETAILED DESCRIPTION OF THE DRAWINGS

Figure 1:
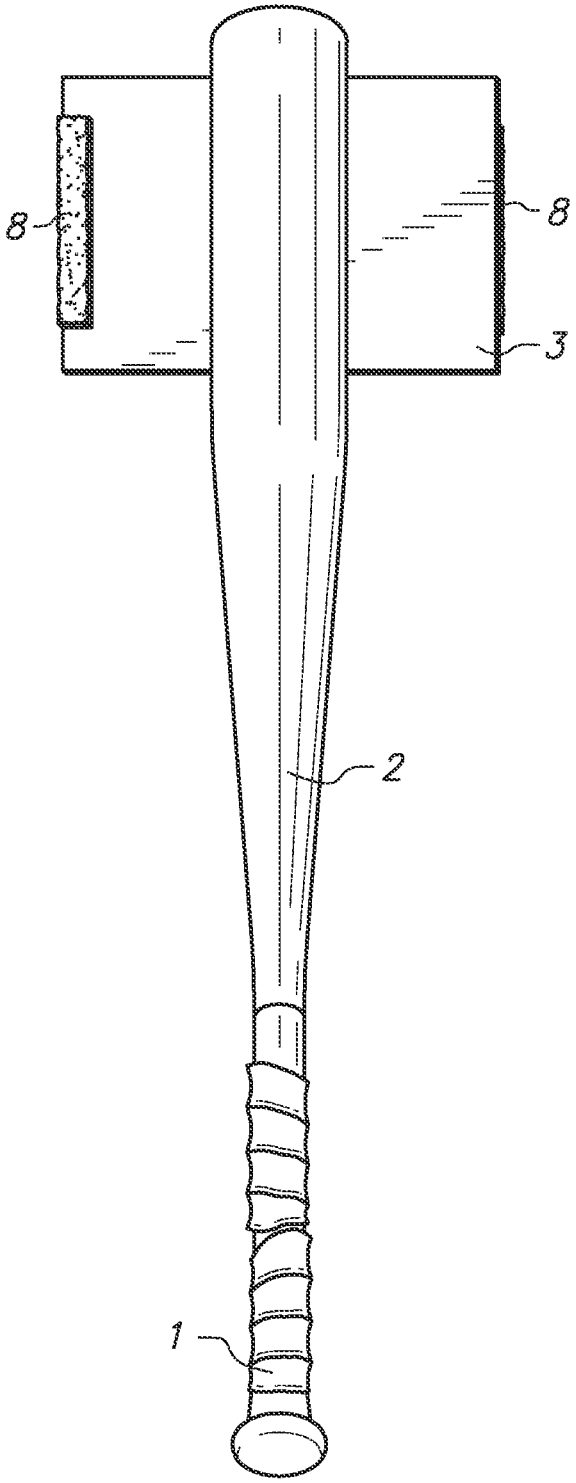
FIG. 1 refers to the body of the current invention, comprising the grip positioner, hitting portion of the bat shaft, and bat swing aid.
Figure 2:
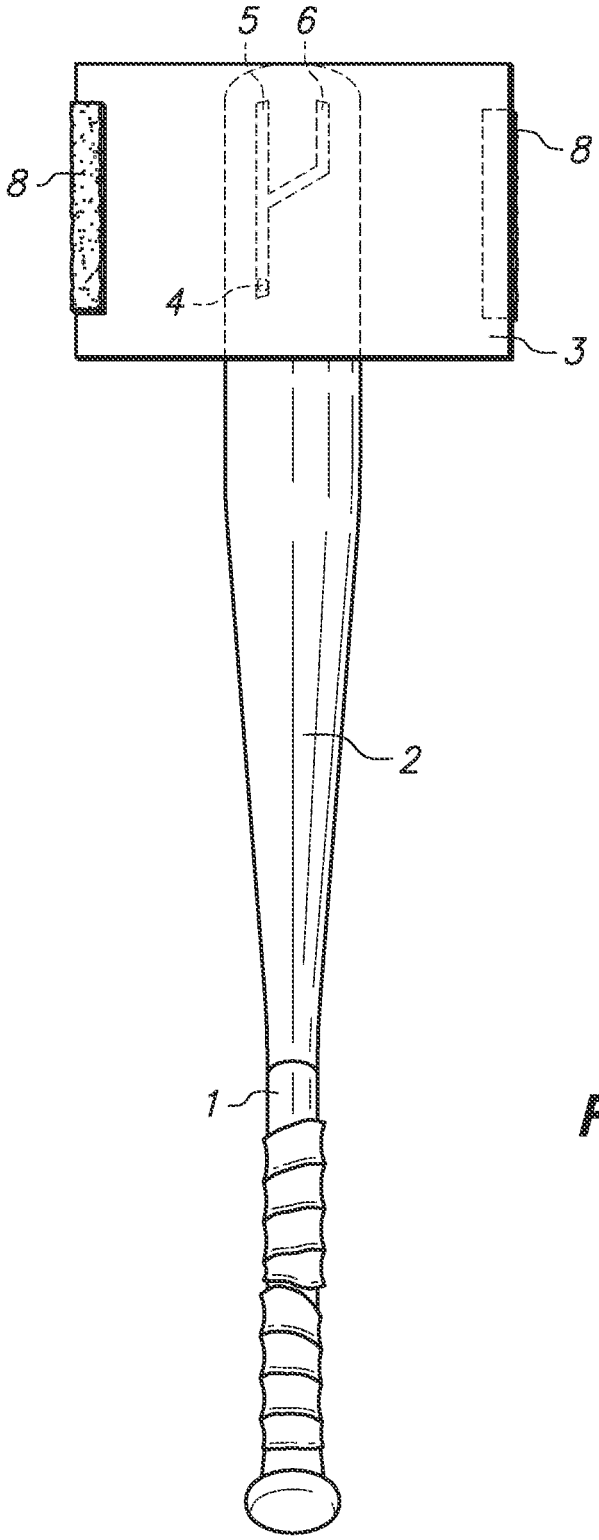
FIG. 2 refers to actual use of the bat training aid, including the grip positioner, bat swing aid, and inertia-propelled elements of the bat swing aid, including the moving bead and separate grooves.
Figure 3A:
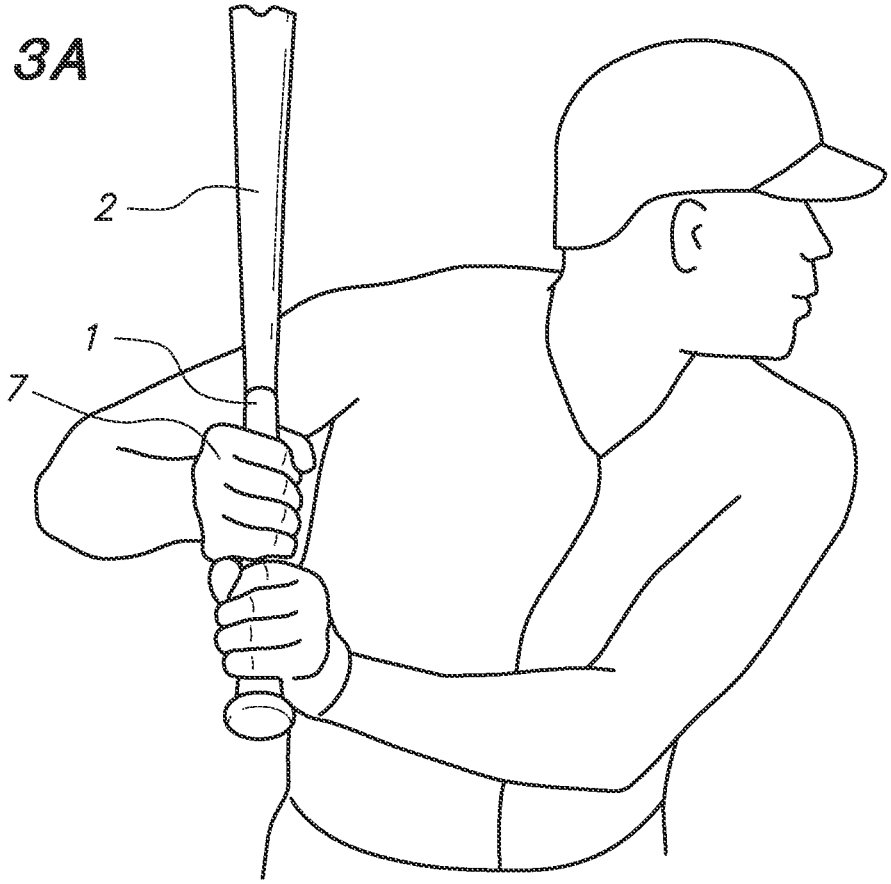
FIG. 3A refers to an active use of the grip positioner attached to a baseball bat and demonstrates the grip aligning properties of the grip positioner.
Figure 3B:
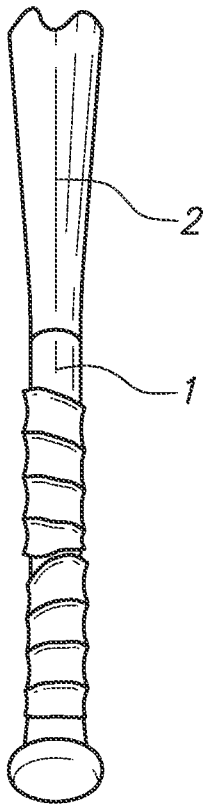
FIG. 3B refers to a baseball bat shaft affixed with a grip positioner, and depicts specific grooves upon which gripping fingers grasp.

FIG. 1 refers to the body of the current invention, wherein element 1 refers to the specifically grooved training grip, element 2 refers to the upper shaft of the bat, and element 3 refers to the swing indicator apparatus;

Next, referring to FIG. 2, which depicts actual use of the bat training aid, element 1 refers to the specifically-grooved training grip, element refers to the upper shaft of the bat, element 3 refers to the swing indicator apparatus as a whole, element 4 refers to the bead which travels along the upper or lower groove in the swing indicator apparatus depending on the batter's swing inertia profile, element 5 refers to the upper groove, and element 6 refers to the lower groove;

Next, referring to FIG. 3A, which is an illustration of the grip positioner device in active use, the batter's hands upon the specifically-molded grooves of the grip positioner show that the batter's middle knuckles are properly aligned along a vertical axis for proper bat gripping. Element 7 refers to the aligned middle knuckles of the two gripping hands due to placement along the preset grooves of the element 1 grip positioner. Element 2 refers to the hitting portion of the baseball bat shaft;

Next, referring to FIG. 3B, which is an illustration of the bottom half of a baseball bat attached with a grip positioner, we find deep set molded grooves in the grip positioner in element 1 which is separate from the hitting portion of the baseball bat shaft in element 2.

Figure 4A:
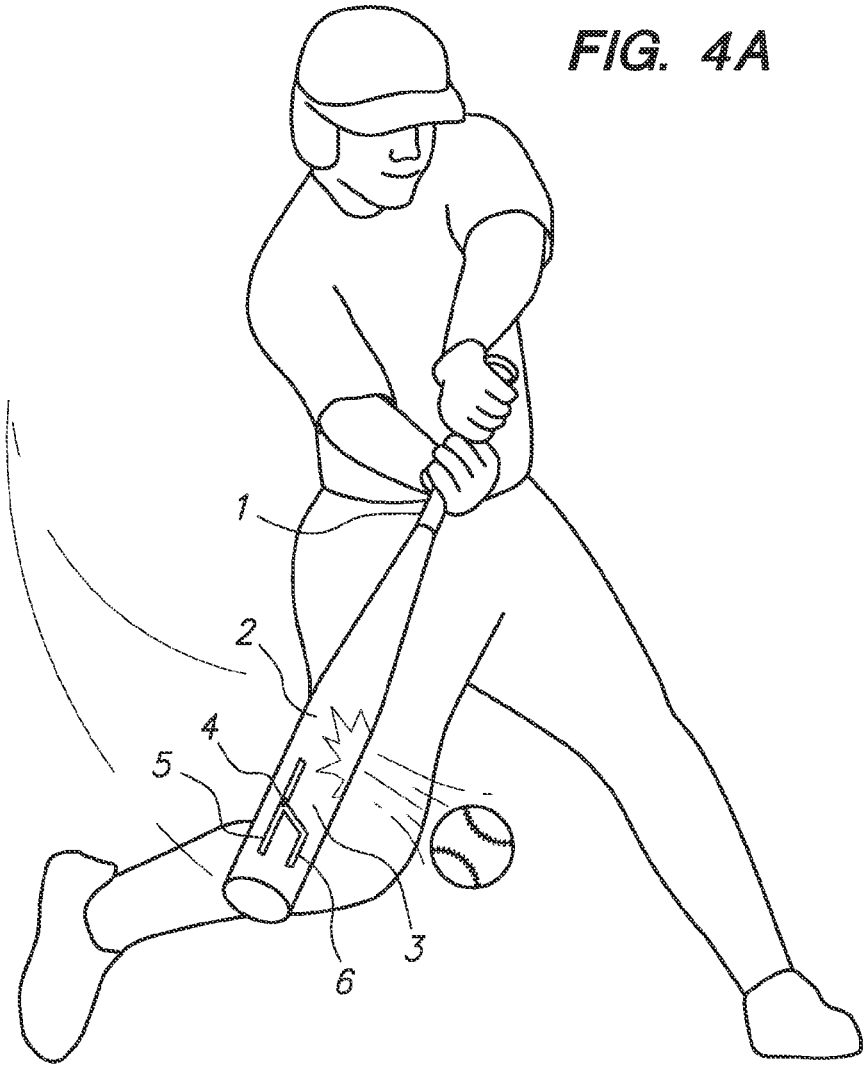
FIG. 4A refers to the mechanism of the bat swing aid, whereby the inertia profile created by a batter correctly swinging the bat propels the bead in the swing aid to the tower groove of the swing aid.

Next, referring to FIG. 4A, which is an illustration of a baseball player swinging a baseball bat with attached grip positioner and baseball bat swinging aid, we find that a correct swing by the batter, whereby the batter first pull by the left elbow then by pushing and casting out the bat to contact the pitched ball, will move the bead (element 4) along the groove in the swinging aid (element 3) by inertia drive. Specially, it is the first action of pulling that move the bead to the lower groove.

Figure 4B:
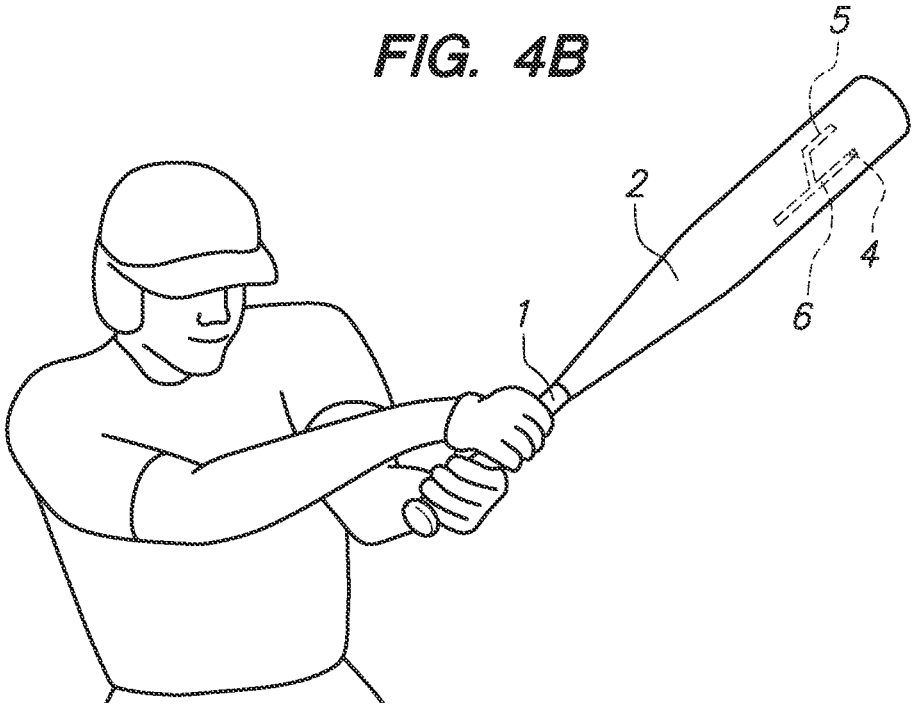
FIG. 4B refers to completion of a correct bat swing, whereby the batter rotates the wrists only after pushing the bat out to contact the baseball, thus forcing the bead into the tower groove of the swing aid.

Next, referring to FIG. 4B, which is a continuation of FIG. 4A wherein the baseball player has correctly pushed the bat forward after first pulling the bat to contact the ball and then rotates the wrists, the bead (element 4) moves along the grooves of the swing aid (element 3) into the lower groove (element 6), where it rests and visually indicates that the batter has performed a technically correct bat swing.

Figure 5:
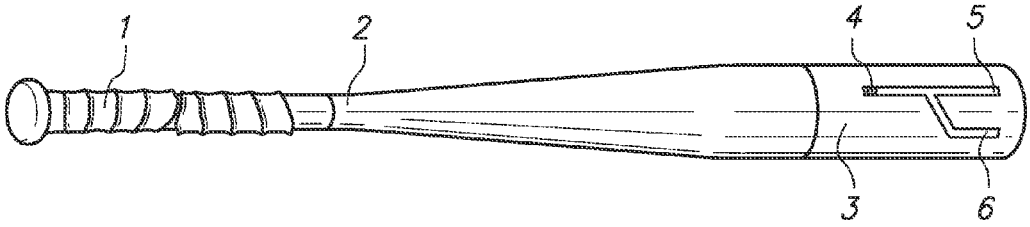
FIG. 5 refers to an embodiment of the invention whereby the grip positioner and bat swing indicator are built into a baseball bat.

Next, referring to FIG. 5, which is a horizontal layout of a baseball bat with built-in grip positioner and swing aid, we find the grip positioner with specifically-molded grooves for proper batting grip (element 1), connected to the hitting portion of the bat shaft (element 2), and a built-in swing aid (element 3) with inertia-propelled bead (element 4) which travels along either the upper groove (element 5) or the lower groove (element 6) depending on the correctness of the bat swing. A correct swing, which entails first pull by the left elbow then by pushing out to contact and strike the baseball, then rotating the wrists afterwards, will result in a proper bat swing, the inertial drive of which first pulling the bat and then cast out will propel the bead (element 4) into the lower groove (element 6) of the bat swing aid (element 3). An incorrect bat swing, whereby the batter cast out without first pulling the elbow prior will create an inertia profile which propels the bead (element 4) across the upper groove (element 5) where it will stay to visually indicate improper batting technique.

Figure 6:
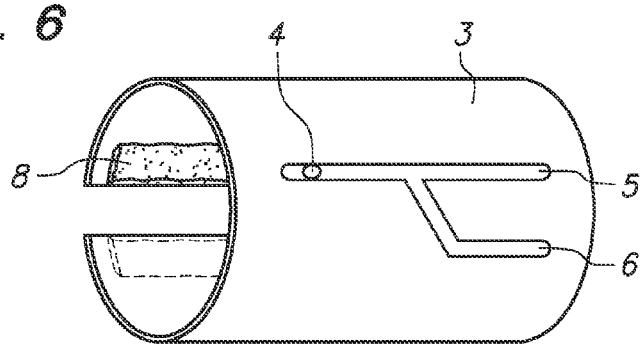
FIG. 6 refers to a standalone embodiment of the bat swing indicator with attachment means for securing the device to a baseball bat shaft.

Next, referring to FIG. 6, which is an independent attachable bat swing aid (element 3), we find the inertia-propelled bead (element 4) which travels along and ends in either the upper groove (element 5) which indicates an improper bat swing or the lower groove (element 6) which indicates a correct bat swing. Element 8 refers to means of attaching and securing the detachable or attachable bat swing aid (element 3) to any size baseball bat or other hitting stick for the same purpose. Means for securing the bat swing aid in element 8 may comprise and is not limited to velcro attachment, button clasp, string-tie means, magnetic clasp, chemical bonding, heat bonding, externally-applied tape means, and form-fitting bat model-specific slip-on means.

Figure 7:
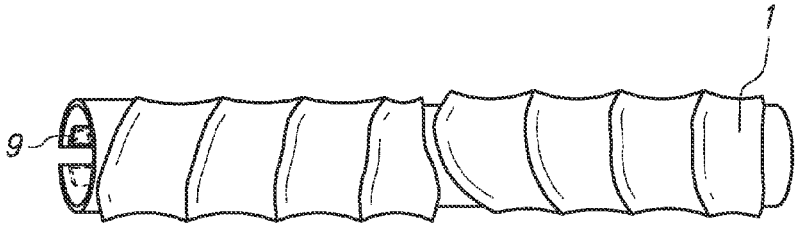
FIG. 7 refers to a standalone embodiment of the grip positioner with attachment means for securing the device to a baseball bat grip.
Figure 8:
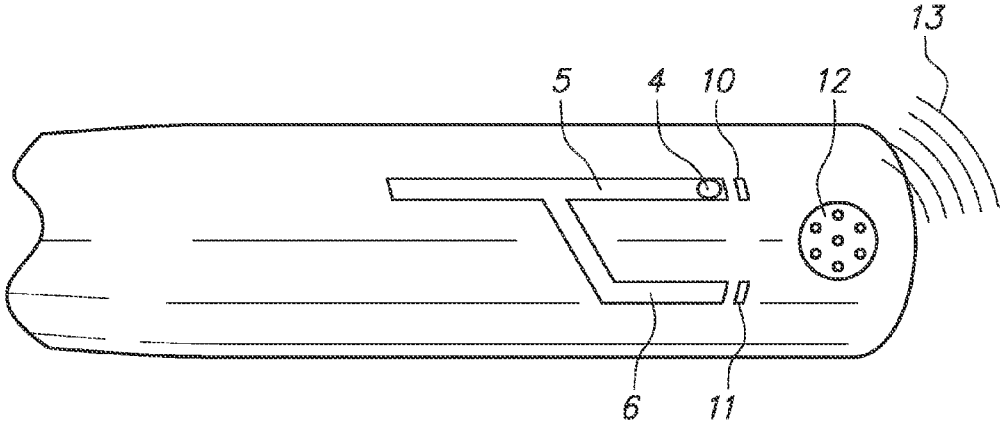
FIG. 8 refers to an embodiment of a bat swing indicator with aural means of indicating whether the swing was technically correct.

Next, referring to FIG. 7, which is an independent attachable grip positioner (element 1), we find specifically-molded finger grooves for properly positioning the gripping hands such that the middle knuckles align vertically along a single axis in a proper baseball bat grip. Element 9 refers to attachment means for securing the grip positioner to any sized baseball bat shaft, which comprise and are not limited to velcro attachment, button clasp, string-tie means, magnetic clasp, chemical bonding, heat bonding, externally-applied tape means, and form-fitting bat model-specific slip-on means;

Next, referring to FIG. 8, which is one embodiment of a bat swing aid indicator with aural indication of correct technique, we find the inertia-propelled bead (element 4) traveling along the upper groove (element 5) and contacting upper groove contact sensor (element 10), which sends an electronic signal to attached speaker or other aural indicator (element 12) and produces an aural indication (element 13) through audio tone or other tone to indicate that the bat swing technique was incorrect, based on the inertia profile of the swing. Element 6 refers to the lower groove of the bat swing indicator, and leads to the lower groove contact sensor (element 11), which would send an electronic signal to attached speaker element 12) to produce an aural indication (element 13) that the bat swing was technically correct.

Figure 9:
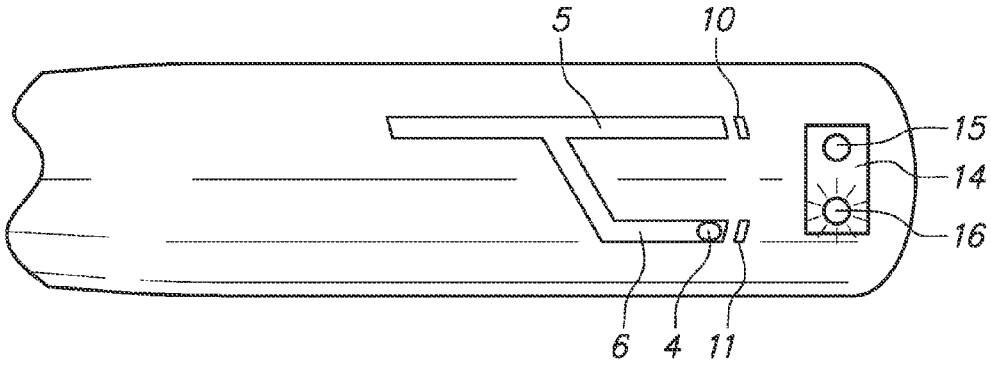
FIG. 9 refers to an embodiment of a bat swing indicator with visual means of indicating whether the swing was technically correct.

Finally, referring to FIG. 9, which is another embodiment of a bat swing aid indicator with visual indication of correct technique, we find the inertia-propelled bead (element 4) traveling along the lower groove (element 6) and contacting the lower groove contact sensor (element 11), which sends an electronic signal to visual indicator unit (element 14) and displays a visual cue at the lower groove light emitting diode, or other visual indicator element 16) to indicate that a correct bat swing was made. Element 10 is a contact sensor for the upper groove (element 5), which upon contact by the bead (element 4) will send an electronic signal to visual indicator unit (element 14) and display a visual cue at the upper groove indicator light emitting diode or other visual indicator (element 15) to indicate that an incorrect bat swing was made.

Figure 10A:
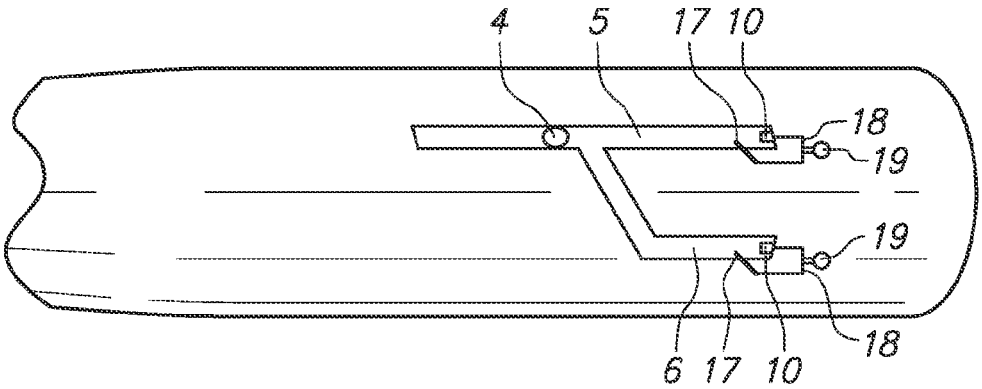
FIG. 10A is an unpowered embodiment of the bat swing aid utilizing spring- and lever-actuated mechanisms to indicate the correctness of the bat swing at the end of each swing.

Finally, referring to FIG. 10A which is an unpowered embodiment of the bat swing aid, we find that the bead (element 4) propelled by the inertia profile of an incorrect bat swing travels through the upper groove (element 5) and contacts the spring-actuated contact sensor (element 10). Thereafter, as seen in FIG. 10B, the force of the bead (element 4) contacting the spring-actuated contact sensor (element 10) causes a spring and lever mechanism (element 18) to force the trap door (element 17) upwards, thus trapping the bead within the end of the groove into which it traveled.

Figure 10B:
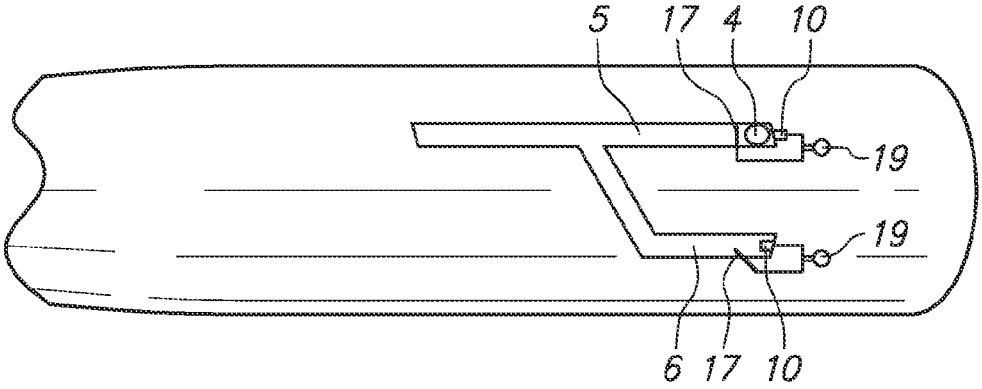
FIG. 10B is a continuation of the action sequence of the unpowered embodiment of the bat swing aid, whereby user manipulation of a spring-loaded reset button releases the bead from its trapped position in a groove and readies the device for a new swing.

Referring to FIG. 10B which is a continuation of the action sequence of the unpowered embodiment of the bat swing aid, user actuation of the spring-operated release button (element 19) located at the end of the upper and lower groove will retract the trap door (element 17), reset the spring-actuated contact sensor (element 10), and reject the bead (element 4) from the groove via positive force of the resetting spring-actuated contact sensor. Thus, the bat swing aid is ready to monitor another bat swing by the user.

Figure 11:
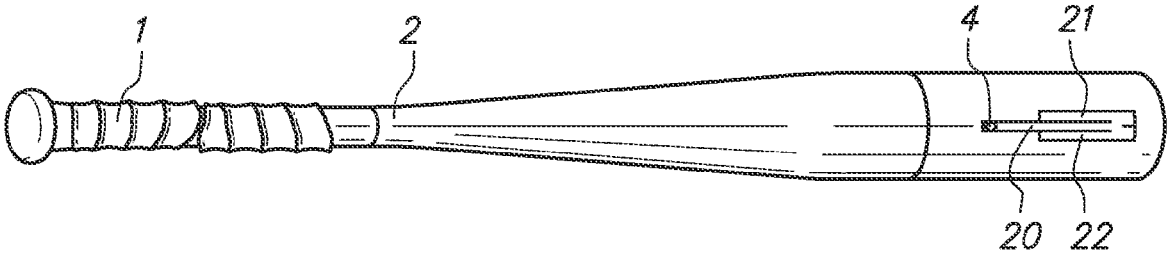
FIG. 11 is another embodiment of the bat swing aid.

Next, referring to FIG. 11, which is another embodiment of the swing aid as disclosed in the present invention, a horizontal layout of a baseball bat with built-in grip positioner and swing aid, we find the grip positioner with specifically-molded grooves for proper batting grip (element 1), connected to the hitting portion of the bat shaft (element 2), and a built-in swing aid (element 3) with inertia-propelled bead (element 4) which travels along the main tube (element 20) and ending up either in the upper tube (element 21) or the lower tube (element 22) depending on the correctness of the bat swing. A correct swing, which entails first pull by the left elbow then by pushing out to contact and strike the baseball, then rotating the wrists afterwards, will result in a proper bat swing, the inertial drive of which first pulling the bat and then cast out will propel the bead (element 4) along the main tube (element 20) and into the lower tube (element 22) of the bat swing aid (element 3). An incorrect bat swing, whereby the batter cast out without first pulling the elbow prior will create an inertia profile which propels the bead (element 4) across along the main tube (element 20) and into the upper tube (element 21) where it will stay to visually indicate improper batting technique. Specifically, there will be an opening at where the main tube (element 20) joins the upper tube (element 21) and the lower tube (element 22) which would allow the bead (element 4) to travel freely to and from the tubes.

What is claimed is:

1. A training device kit for baseball players to train themselves in the proper way to swing a baseball bat comprising a baseball bat having a barreled head and a handle; and a training apparatus for indicating the proper way to swing said bat;

wherein said training apparatus is integral to said bat or separately attachable to said bat;

wherein said training apparatus comprising a grooved portion parallel to the longitudinal axis of said bat and a separate bead which rests in said grooved portion of said training apparatus and freely moves within said grooved portion of said training device when the bat is swung.

2. The device in claim 1, wherein said groove path comprises an upper groove path and a lower groove path.

3. The device in claim 2, wherein said upper groove path and said lower groove path form a lateral Y shape groove path.

4. The device in claim 2, wherein said ball will enter said lower groove when a batter properly swing said baseball bat.

5. The device in claim 2, wherein said bead will enter said upper groove when a batter incorrectly swings said baseball bat.

6. The device in claim 2, wherein said bead moves within said upper and said lower groove based on the inertia profile created by a batter's swing.

7. The device in claim 1, wherein said groove path comprises main tube path, an upper tube path and a lower tube path.

8. The device in claim 7, wherein said bead will enter said lower tube path when a batter properly swings said baseball bat.

9. The device in claim 7, wherein said bead will enter said upper tube path when said a batter incorrectly swings said baseball bat.

10. The device in claim 1, wherein said kit further comprises a grip-positioning molded grip.

11. The device in claim 10, wherein said grip is specifically molded wherein a batter's hands are properly aligned with each other wherein said batter can manipulate said baseball bar properly when attempting to hit the baseball and said batter's knuckles are properly lined up.

* * * * *